United States Patent [19]

Sittmann

[11] 3,936,063

[45] Feb. 3, 1976

[54] RETAINING MECHANISM FOR SKI BINDINGS

[75] Inventor: Brigitte Sittmann, Stuttgart, Germany

[73] Assignee: Vereinigte Baubeschlagfabriken Gretsch and Co. GmbH, Germany

[22] Filed: July 10, 1974

[21] Appl. No.: 487,131

[30] Foreign Application Priority Data

July 12, 1973 Germany ..... 2335473

[52] U.S. Cl. ..... 280/11.35 P

[51] Int. Cl.[2] ..... A63C 9/00

[58] Field of Search...280/11.35 K, 11.35 C, 11.35 P, 280/11.35 F, 11.35 R, 11.35 O, 11.35 E, 11.35 H

[56] References Cited

UNITED STATES PATENTS 2,950,119 8/1960 Gembruch ..... 280/11.35 T 3,838,866 10/1974 D'Alessio et al. ..... 280/11.35 K

FOREIGN PATENTS OR APPLICATIONS 685,834 12/1939 Germany ..... 280/11.35 F

*Primary Examiner*—M. Henson Wood, Jr.
*Assistant Examiner*—Milton L. Smith
*Attorney, Agent, or Firm*—Craig & Antonelli

[57] ABSTRACT

A retaining mechanism for ski bindings with a curved retaining member, retaining tightener or the like serving for the retention of the boot, which is adapted to be inserted into lateral cross bores of a sole plate or a similar part arranged on the ski by means of inwardly directed pin portions; the cross bores are provided both with an internal thread for receiving pin portions provided with corresponding external threads and with bayonet-like grooves for pin portions provided with elements to be coupled with the grooves in a bayonet-like manner.

8 Claims, 5 Drawing Figures

FIG.1
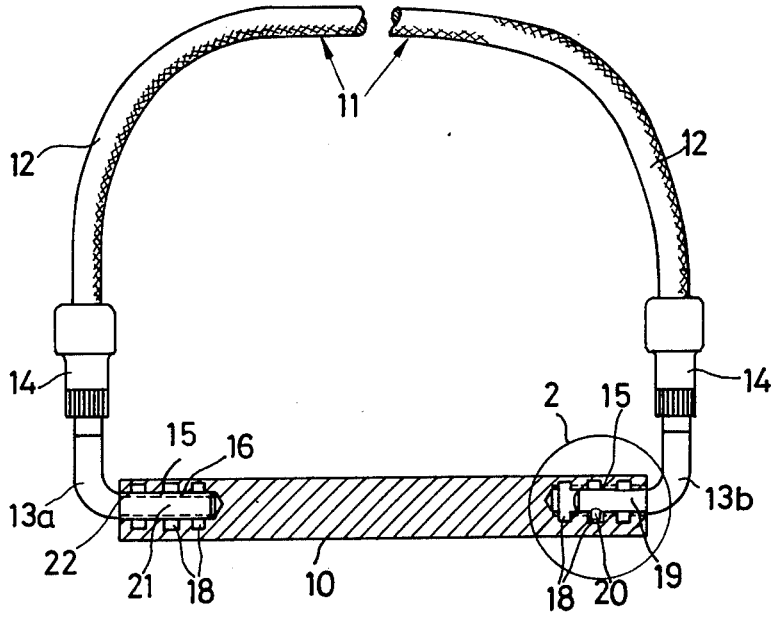
FIG.2
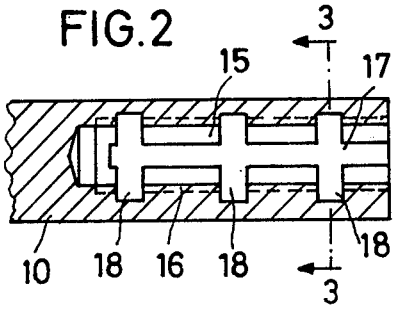
FIG.4
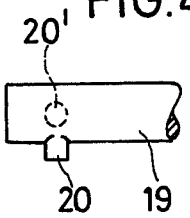
FIG.5
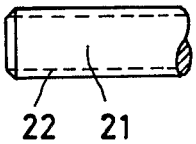
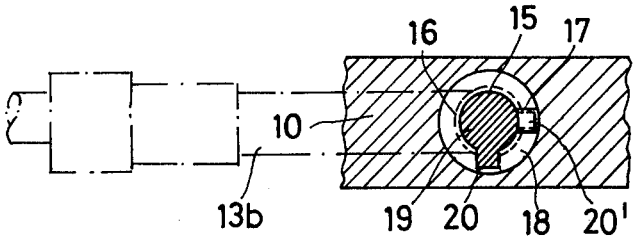
FIG.3

RETAINING MECHANISM FOR SKI BINDINGS

The present invention relates to a retaining mechanism for ski bindings with a curved retaining member, retaining tighteners or the like serving for the retention of the boot, which is adapted to be inserted into lateral cross bores of a sole plate or of a similar part arranged at the ski by means of inwardly directed pin portions.

It is known to connect such curved retaining members or holding tighteners, for example, by means of a cable element or spring elements placed about the heel, with the ski or with a fitting secured on the ski in that they are screwed with their pin-like ends by means of a thread into the cross bores of the ski or of the fitting provided with a corresponding thread.

A bayonet-like connection is also known, in which the pin-like ends of the holding tighteners are inserted into the cross bores in a non-use-pivot position of the tightener and are locked therein bayonet-like by pivoting the tightener into the use position. However, with such constructions one is tied to the use of retaining or holding elements which are provided either with a corresponding thread or with corresponding elements to be locked bayonet-like.

The present invention is concerned with the task to enable a more universal useability of the ski or of the sole plate with arcuate retaining members, retaining tighteners or similar holding devices which are constructed differently or are to be coupled differently. Accordingly, the present invention essentially consists in that the cross bores are provided both with a thread for the accommodation of pin portions provided with a corresponding counter thread and with bayonet-like grooves for the accommodation of pin portions of the arcuate retaining members, retaining tighteners or the like provided with corresponding elements to be coupled with the grooves in a bayonet-like manner.

These and further objects, features and advantages of the present invention will become more apparent from the following description when taken in connection with the accompanying drawing which shows, for purposes of illustration only, one embodiment in accordance with the present invention, and wherein:

FIG. 1 is a cross-sectional view through a ski or sole plate with a curved retaining member according to the present invention, and more particularly with a bayonet-like connection in the right half and with a threaded connection in the left half;

FIG. 2 is a partial cross-sectional view, on an enlarged scale, illustrating the detail indicated by the circle 2 of FIG. 1, however, with the curved retaining member removed for the sake of clarity;

FIG. 3 is a cross-sectional view taken along line 3—3 of FIG. 2;

FIG. 4 is a partial elevational view of the end of a curved retaining member for a bayonet-like coupling with the ski or the sole plate; and FIG. 5 is a partial elevational view of an end of a curved retaining member with a threaded connection.

Referring now to the drawing wherein like reference numerals are used throughout the various views to designate like parts, an arcuate retaining member generally designated by reference numeral 11 is connected with a sole plate 10 or with a corresponding part (under certain circumstances, with the ski itself). The arcuate retaining member 11 is subdivided into a center, preferably flexible U-shaped part 12 and into angularly shaped, inwardly bent leg end parts **13*a* and 13*b* which are connected with the center part 12 by coupling devices, for example, by threaded connections 14** with sleeve nut or the like.

The sole plate 10 is provided at both longitudinal sides with cross bores 15 which, as illustrated in particular in FIGS. 2 and 3, are provided both with an internal thread 16 and with grooves 17 and 18 arranged bayonet-like. The groove 17 extends in the longitudinal direction of the bore 15 whereas the grooves 18 branch off from the longitudinal groove 17 as ring-shaped cross grooves. In lieu of extending over the entire circumference of the circle, the grooves 18 may possibly extend only over a part of the circumference of the bore 15.

In the right half of FIG. 1, the leg end part **13*b* is bent into a pin-like cylindrical end 19 which is constructed with a lateral pin 20 as shown in particular in FIG. 4. The pin 20 serves as counter element for the bayonet-like grooves 17 and 18. For purposes of coupling the arcuate retaining member 11 or the end parts 13*b* of the arcuate retaining member 13 with the ski or the sole plate 10, the pin-like cylindrical ends 19 whose diameter corresponds approximately to the inner diameter of the cross bores 16 provided with a thread, are inserted with the pins 20 in such a rotational position 20' (FIGS. 3 and 4) that they are aligned with the longitudinal grooves 17 and within these grooves can be displaced inwardly until they are rotatable in one of the cross grooves 18 and assume the position illustrated in FIGS. 1, 3 and 4. It is achieved by the position of the longitudinal groove, illustrated in particular in FIG. 3, that the arcuate retaining member 11** cannot become disconnected by itself when no boot is clamped in.

The left side of FIG. 1 shows the coupling of an arcuate retaining member 11 by means of a leg end part **13*a* whose inwardly bent pin-like end 21 is provided with an external thread 22 which is adapted to be screwed-in fittingly into the internal thread 16 of the threaded bore 15**.

The advantage of the present invention resides in particular in that by the construction of the cross bores both with a thread 16 and with grooves 17 and 18 arranged bayonet-like, the retaining member 11 can be connected with the sole plate 10 or with another part with the use of the leg end parts **13*a* by means of a threaded connection and with the use of the leg end parts 13*b*** by means of bayonet connections. The latter type of connection is required especially in the ski rental business.

Preferably, several cross bores 15 are arranged one behind the other in the sole plate 10 so that the arcuate retaining member or the corresponding holding device can be adjusted in the ski longitudinal direction depending on the boot size. Furthermore, as shown in FIG. 2, several circumferential cross grooves 18 are provided disposed one behind the other along the groove 17 with a predetermined mutual spacing so that a certain adjustability is also provided by the existence of these grooves.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

What I claim is:

1. A retaining mechanism for ski bindings with a retaining means serving for retaining a ski boot, said retaining means being adapted to be inserted by means of inwardly directed pin portions into lateral cross bores provided on a relatively fixed part, the cross bores being provided with a thread for the accommodation of pin portions provided with corresponding counter threads and with bayonet-like grooves for the accommodation of pin portions provided with corresponding elements to be coupled bayonet-like with said grooves, whereby retaining means with pin portions having either bayonet-like or threaded ends may alternatively be utilized with the same cross bores.

2. A retaining mechanism according to claim 1, wherein said fixed part is a sole plate.

3. A retaining mechanism according to claim 1, wherein said retaining means includes a curved center portion, said pin portions being threadedly coupled to said center portion.

4. A retaining mechanism according to claim 1, wherein said bayonet-like grooves include longitudinal and cross grooves, several cross grooves being provided in the direction of the longitudinal groove for the bayonet-like connection.

5. A retaining mechanism according to claim 1, wherein several cross bores are provided along the sides of the fixed part which are spaced from each other by a predetermined amount, each of said cross bores being provided with a thread and with the bayonet-like grooves.

6. A retaining mechanism according to claim 5, wherein several cross grooves are provided disposed one behind the other in the direction of a corresponding longitudinal groove of the respective cross bore.

7. A retaining mechanism according to claim 8, wherein said fixed part is a sole plate.

8. A retaining mechanism according to claim 6, wherein said retaining means includes a curved center portion, said pin portion being threadably coupled to said center portion.

* * * * *